US009617026B2

(12) United States Patent
Han

(10) Patent No.: US 9,617,026 B2
(45) Date of Patent: Apr. 11, 2017

(54) PACKAGING BAG AND METHOD OF MANUFACTURING THE SAME

(71) Applicant: PacSense Corp., Edgewater, NJ (US)

(72) Inventor: Su Youn Han, Edgewater, NJ (US)

(73) Assignee: PacSense Corp., Edgewater, NJ (US)

( * ) Notice: Subject to any disclaimer, the term of this patent is extended or adjusted under 35 U.S.C. 154(b) by 0 days.

(21) Appl. No.: 14/849,971

(22) Filed: Sep. 10, 2015

(65) Prior Publication Data

US 2016/0083146 A1 Mar. 24, 2016

(30) Foreign Application Priority Data

Sep. 22, 2014 (KR) ..... 10-2014-0126083

(51) Int. Cl.
*B65D 33/10* (2006.01)
*B65D 33/08* (2006.01)
(Continued)

(52) U.S. Cl.
CPC ..... *B65B 61/16* (2013.01); *B65B 7/02* (2013.01); *B65B 43/06* (2013.01); *B65D 75/566* (2013.01)

(58) Field of Classification Search
CPC ..... B65D 33/08; B65D 33/02; B65D 75/566; B65B 61/16; B65B 7/02; B65B 43/06
(Continued)

(56) References Cited

U.S. PATENT DOCUMENTS 4,761,080 A * 8/1988 Schirmer ..... B32B 27/08 206/524.2
5,758,971 A * 6/1998 Goglio ..... B65D 31/10 383/10
(Continued)

FOREIGN PATENT DOCUMENTS

EP 0749908 B1 7/2001
JP 05-239755 A 9/1993
(Continued)

OTHER PUBLICATIONS

International Search Report and the Written Opinion of the International Searching Authority issued in corresponding International application No. PCT/US2015/049317, date of mailing: Feb. 11, 2016.
(Continued)

*Primary Examiner* — Derek Battisti
(74) *Attorney, Agent, or Firm* — Plumsea Law Group, LLC

(57) ABSTRACT

Provided are a packaging bag in which the breakage of a handle or irritation to a user's hand due to a load of the packaging bag when the user moves while gripping the handle in a state in which heavy contents such as grain or the like fills the packaging bag can be minimized by forming a sealed handle at the packaging bag, and a method of manufacturing the same.
The packaging bag includes a packaging sheet constituted by a first sheet, and second sheets extending from both sides of the first sheet to be folded in a rear-surface direction of the first sheet so that both ends overlap to be sealed; a reinforcement film inserted and fixed between the first sheet and the second sheets; an upper sealing section sealed so that inner surfaces of the reinforcement film and the packaging sheet adhere to seal an upper section; and a handle section positioned at the upper sealing section and punched to be gripped.

7 Claims, 6 Drawing Sheets

(51) Int. Cl.

| | |
|---|---|
| ***B65B 61/16*** | (2006.01) |
| ***B65B 43/06*** | (2006.01) |
| ***B65B 7/02*** | (2006.01) |
| ***B65D 75/56*** | (2006.01) |

(58) Field of Classification Search
USPC ..... 383/10
See application file for complete search history.

(56) References Cited

U.S. PATENT DOCUMENTS

| | | | | |
|---|---|---|---|---|
| 5,914,142 | A * | 6/1999 | Zartner | B65D 33/08 383/10 |
| 6,729,109 | B2 | 5/2004 | Knoerzer et al. | |
| 6,886,980 | B1 * | 5/2005 | Diplock | B65D 33/34 383/10 |
| 6,923,574 | B2 * | 8/2005 | Siegel | B65D 33/08 383/10 |
| 8,342,587 | B2 * | 1/2013 | Johnson | B65D 33/065 294/149 |
| 2002/0102032 | A1 * | 8/2002 | Sturgis | B65D 33/08 383/10 |
| 2003/0235348 | A1 * | 12/2003 | Pape | B65D 33/24 383/7 |
| 2005/0276521 | A1 * | 12/2005 | Price | B31B 19/36 383/10 |
| 2009/0170681 | A1 * | 7/2009 | Kohn | B65D 33/065 493/223 |
| 2010/0142859 | A1 | 6/2010 | Cushman | |
| 2010/0273377 | A1 * | 10/2010 | Files | B32B 27/32 442/49 |
| 2011/0019937 | A1 * | 1/2011 | Steinwagner | B65D 31/10 383/10 |

FOREIGN PATENT DOCUMENTS

| | | | |
|---|---|---|---|
| JP | 2008-308214 | A | 12/2008 |
| KR | 20-2000-0011395 | U | 7/2000 |
| KR | 20-2010-0007262 | U | 7/2010 |
| KR | 10-1079674 | B1 | 10/2011 |

OTHER PUBLICATIONS

Notice of Allowance issued in Korean patent application No. 10-2014-0126083, Mar. 30, 2015. (with English Translation).
Office Action issued in Korean patent application No. 10-2014-0126083, Dec. 8, 2014. (with English Translation).

* cited by examiner

PACKAGING BAG AND METHOD OF MANUFACTURING THE SAME

BACKGROUND OF THE INVENTION

Field of the Invention

The present invention relates to a packaging bag and a method of manufacturing the same, and more particularly, to a packaging bag in which the breakage of a handle or irritation to a user's hand due to a load of the packaging bag when the user moves while gripping the handle in a state in which heavy contents such as grain or the like fills the packaging bag can be minimized by forming a sealed handle on the packaging bag, and a method of manufacturing the same.

Description of Related Art

A packaging bag is a thin bag formed of a synthetic resin used for various purposes including containing solid or fluid goods therein. Packaging bags are generally stored in the form of a roll continuously wound in a state in which perforated lines are formed therein, or in a state in which the packaging bags are accommodated in a paper box or the like, sheet by sheet.

In recent times, as the number of single-person households has increased, food packaged for single persons or in small amounts has been gaining popularity. Among these, when a large amount of grain such as rice is purchased, the flavor of the grain remarkably worsens when it is stored for a long period of time. Accordingly, the number of stores that sell grains packaged in small packaging bags for single-person households or small families is increasing.

Such a packaging bag is formed in a rectangular bag shape with the upper and lower ends thereof sealed. Even though the packaging bag includes heavy contents, there is no handle to be gripped by a user, and thus conveyance of the packaging bag is very inconvenient.

In consideration of this, a packaging bag is disclosed in Korean Utility Model Registration No. 20-0410022, entitled "Packaging Bag Including Handle."

The packaging bag including the handle in the related art is a packaging bag including a handle of a new structure in which storage and conveyance are easy and cost is reduced due to a simple structure and a small volume, and automated filling of contents is easy. In the packaging bag sealed at upper and lower ends thereof in a state in which contents are contained, a handle is further provided at the upper end of the packaging bag, and the handle includes a grip section gripped by a user's hand, and connecting sections extending from both sides of the grip section and having ends fixed to the upper end of the packaging bag.

However, the packaging bag including the handle is configured by attaching a separate handle, and when a user carries the packaging bag for a long period of time, the handle attached to the packaging bag may break due to the load of the packaging bag. In particular, when the packaging bag is formed of a synthetic resin, a portion to which the handle is attached may weaken and a connecting portion between the packaging bag and the handle may break.

In addition, as the separate handle is attached to the packaging bag, productivity is decreased by the complicated manufacturing process, and the manufacturing cost of the packaging bag may increase due to an increase in material costs.

CITATION LIST

Patent Literature

[Patent Literature 1] Korean Utility Model Registration No. 20-0410022 (Registered Feb. 22, 2006)

[Patent Literature 2] Korean Patent Registration No. 10-0837179 (Registered Jun. 4, 2008)

[Patent Literature 3] Korean Patent Registration No. 10-0969662 (Registered Jul. 5, 2010)

SUMMARY OF THE INVENTION

The present invention is directed to provide a packaging bag in which the breakage of a handle section during use due to the load of heavy contents such as grain or daily supplies can be prevented by sealing the handle section at a portion spaced a certain interval from a rim of the handle section.

In addition, the present invention is directed to provide a packaging bag in which the occurrence of injury or marks left on a user's hand that grips the handle section due to the load of heavy contents can be minimized by forming a folding section at the handle section.

Further, the present invention is directed to provide a method of manufacturing a packaging bag in which durability and productivity of products can be improved, and manufacturing costs of an automated process can be reduced by using a packaging sheet and a reinforcement film that are continuously supplied.

Aspects of the invention are not limited to the aspects described above, and other aspects, which are not described above, can be understood by those skilled in the art based on the description below.

A packaging bag according to the present invention includes a packaging sheet constituted by a first sheet, and second sheets extending from both sides of the first sheet to be folded in a rear-surface direction of the first sheet so that both ends overlap to be sealed; a reinforcement film inserted and fixed between the first sheet and the second sheets; an upper sealing section sealed so that inner surfaces of the reinforcement film and the packaging sheet adhere to seal an upper section; and a handle section positioned at the upper sealing section and punched to be gripped.

The packaging sheet may include a rear sealing section sealed in a state in which a non-woven fabric is attached to both sides of the second sheets in contact with the first sheet.

In the upper sealing section, a region other than a region spaced a certain interval from a rim of the handle section formed on the upper section of the packaging sheet may be sealed.

The handle section may include a folding section formed on a rim thereof so that the first sheet and the second sheets provided on both sides of the reinforcement film are folded in a bundle.

The packaging sheet may include a zipper which is installed and fixed to a lower section and is opened and closed so that grain is inserted or discharged.

In addition, a method of manufacturing a packaging bag according to the present invention includes a first step of supplying a packaging sheet formed in a state in which second sheets overlap a first sheet; a second step of supplying a reinforcement film to be positioned on the first sheet and cutting the reinforcement film while performing a first sealing process of sealing the reinforcement film on the first sheet by a preset length; a third step of covering the reinforcement film by folding one ends of the second sheets formed on both sides of the first sheet inward to face each other; a fourth step of performing a second sealing process so that the facing one ends of the second sheets adhere to each other to form a rear sealing section in a longitudinal direction; a fifth step of performing a third sealing process so that the reinforcement film, the first sheet and the second sheets adhere to form an upper sealing section; a sixth step of punching a handle section in the reinforcement film of the packaging sheet processed in the fifth step; a seventh step of cutting the packaging sheet processed in the sixth step with a preset length; and an eighth step of performing a fourth sealing process so that an opening is sealed to form a lower sealing section after a cut portion of the packaging sheet cut in the seventh step is opened and grain is inserted into the opening.

In the second step, the second sheets may be spaced at a certain interval in an outward direction to obtain a space so that the reinforcement film is sealed with the packaging sheet supplied in the first step.

In the fourth step, the sealing may be performed in a state in which a non-woven fabric is attached to the one ends of the second sheets in the longitudinal direction.

In the sixth step, the punching may be performed so that a margin from a rim of the handle section remains.

DETAILED DESCRIPTION OF THE INVENTION

Figure 1:
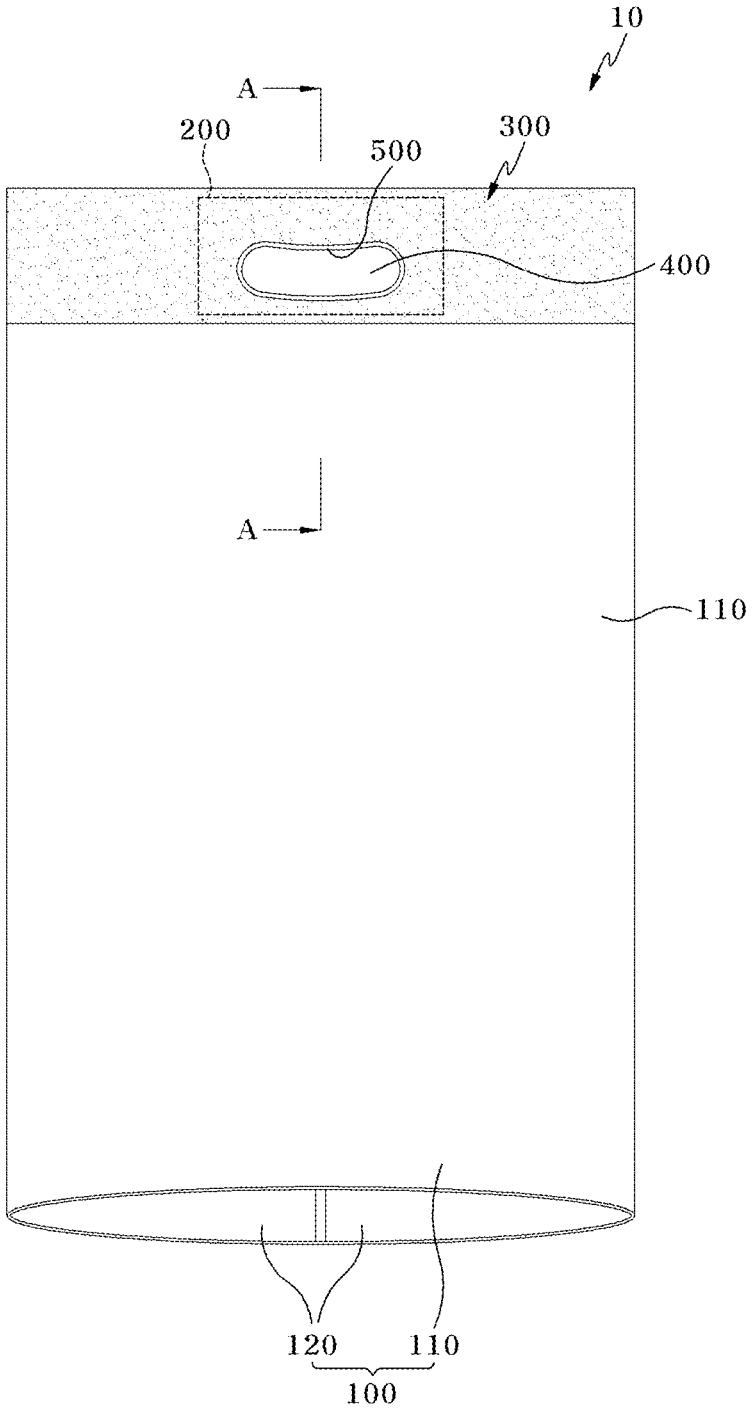
FIG. 1 is a front view of a packaging bag according to the present invention.

Advantages and characteristics of the invention and methods of accomplishing those will be clarified with reference to the accompanying drawings and examples described in detail below. However, the invention is not limited to the examples described herein, and may be realized in other forms. The embodiments described herein are provided to fully convey the spirit of the invention to those skilled in the art so that the described contents are to be exhaustive and perfect. In the drawings, the thicknesses of layers and regions may be exaggerated for clarity.

It will be understood that, although the terms "first," "second," and the like may be used herein to describe various elements, these elements should not be limited by these terms. These terms are only used to distinguish one element from another. For example, a first element could be termed a second element, and similarly, a second element could be termed a first element without departing from the scope of the present invention.

It will be understood that the terms "upper end," "lower end," "upper surface," "lower surface," "upper section," "lower section," and so on may be used herein to distinguish relative positions of elements. For example, when an upper side of the drawing is referred to as an upper section and a lower side of the drawing is referred to as a lower section, the upper section may be referred to as the lower section and the lower section may be referred to as the upper section without departing from the scope of the present invention.

Terms used herein are provided for explaining embodiments of the present invention, not limiting the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, numbers, steps, components, actions, and/or devices, but do not preclude the presence or addition of one or more other features, numbers, steps, components, actions, and/or devices.

Unless the context clearly indicates otherwise, terms including technical or scientific terms used herein have the same meaning that those skilled in the art, to which the invention belongs, understand ordinarily. A term ordinarily used as defined by a dictionary should be construed to have a meaning equal to that in the context of a related description, and should not be construed in an ideal or excessively formal meaning unless it is clearly defined in the present specification.

Hereinafter, an exemplary embodiment of a packaging bag according to the present invention will be described in detail with reference to the accompanying drawings.

Figure 2:
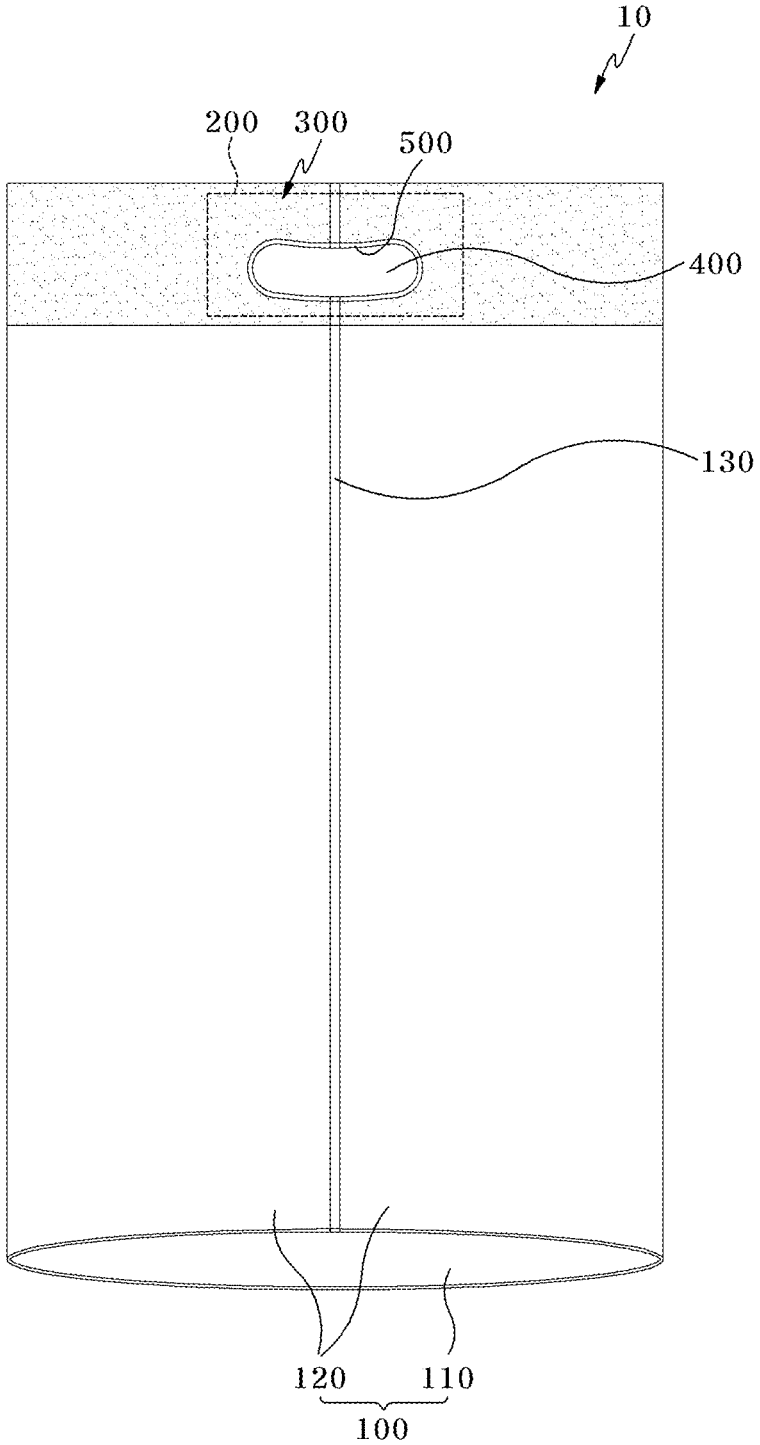
FIG. 2 is a rear view of the packaging bag according to the present invention.
Figure 3:
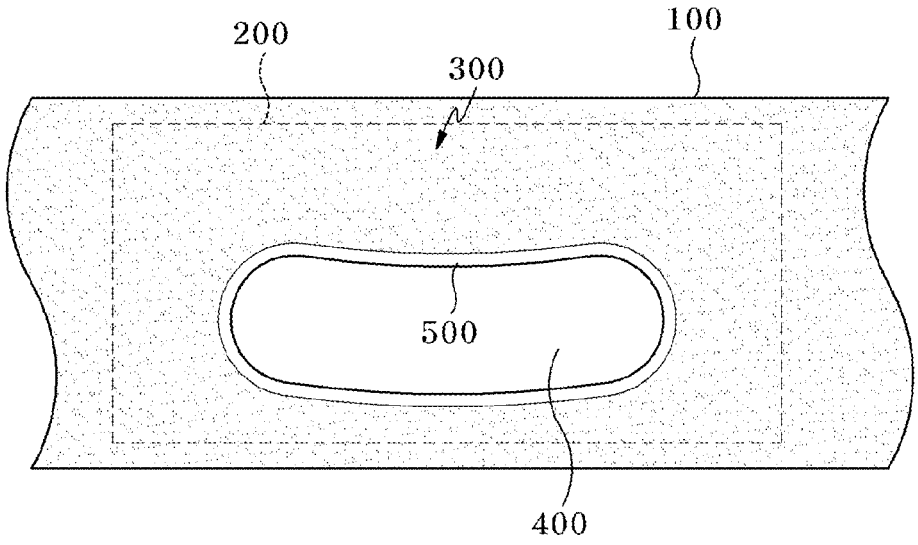
FIG. 3 is an enlarged view of a handle section of the packaging bag according to the present invention.
Figure 4:
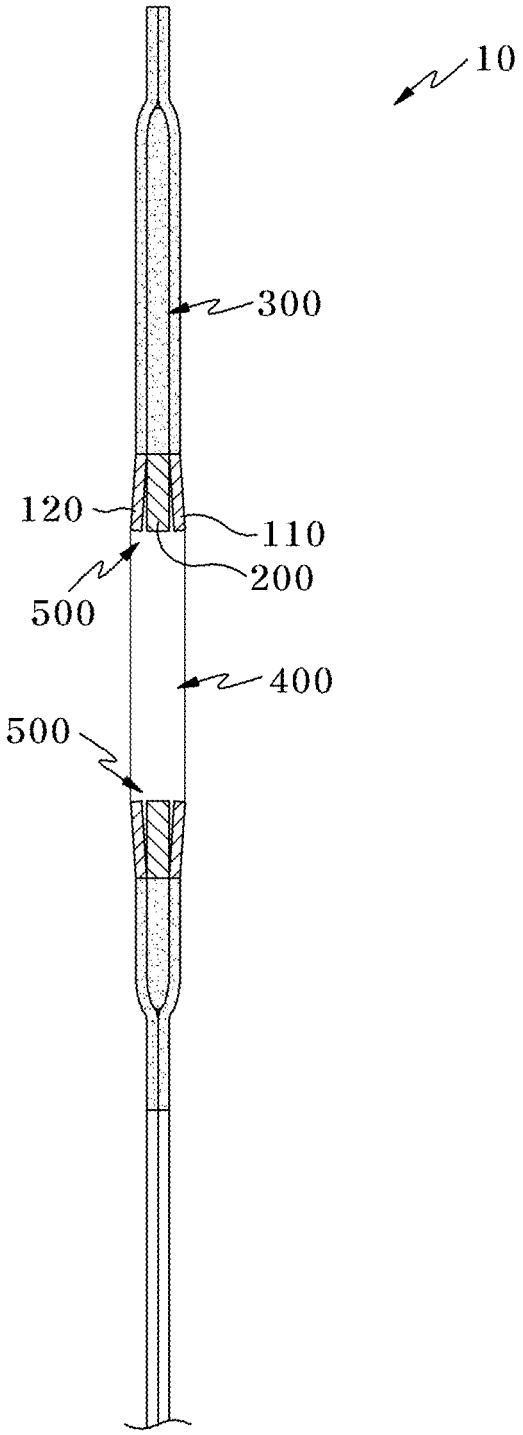
FIG. 4 is a cross-sectional view taken along line A-A of FIG. 1 of the packaging bag of the present invention.

FIG. 1 is a front view of a packaging bag according to the present invention, FIG. 2 is a rear view of the packaging bag according to the present invention, FIG. 3 is an enlarged view of a handle section of the packaging bag according to the present invention, and FIG. 4 is a cross-sectional view taken along line A-A of FIG. 1 of the packaging bag of the present invention.

Referring to FIGS. 1 to 4, a packaging bag 10 according to the present invention may include a packaging sheet 100, a reinforcement film 200, an upper sealing section 300 and a handle section 400.

The packaging sheet 100 may be formed of any one of a synthetic resin, laminated paper, nylon and PET. However, the packaging sheet is not limited thereto, and may be formed of any material as long as the packaging sheet is formed in the shape of a packaging bag, T-type pouch, 3-side seal pouch, or the like in which articles can be packaged or stored.

In addition, the packaging sheet 100 may be sealed through various sealing methods such as radio frequency sealing, hot welding, ultrasonic sealing, or the like. Since the principles of sealing are known to those skilled in the art, specific description thereof will be omitted in the embodiment of the present invention. The packaging sheet 100 may include a first sheet 110 and second sheets 120 to form a space so that grains such as white rice, brown rice, various other grains, or the like, can be accommodated therein.

Here, the first sheet 110 is a front section of the packaging sheet 100, and the second sheets 120 are a rear section of the packaging sheet 100.

The second sheets 120 extend from both sides of the first sheet 110 so that both ends of the second sheets 120 face and overlap each other in a rear-surface direction of the first sheet 110 to be sealed to form a rear sealing section 130. The second sheets 120 may be sealed while a non-woven fabric (not shown) is attached to both ends to prevent the rear sealing section 130 from being deformed when the first sheet 110 and the second sheets 120 are sealed or to prevent the contents from being exposed due to damage to the sealed portion caused by an external force. Meanwhile, in addition to the non-woven fabric, a synthetic fabric or a synthetic resin formed of various materials may be used.

The reinforcement film 200 may be positioned on the upper section of the packaging sheet 100, sealed and fixed between the first sheet 110 and the second sheets 120, and provided to prevent the handle section 400 from tearing. The reinforcement film 200 is sealed to be first fixed onto the first sheet 110. Here, the entire region of the handle section 400 except for a region spaced a certain interval from a rim thereof may be sealed, or only a part thereof may be sealed. The reinforcement film 200 may be omitted according to circumstances.

That is, in the packaging bag 10 in which only light contents are accommodated, even when the entire region of the handle section 400 except for the region spaced the certain interval from the rim is sealed in a state in which the reinforcement film 200 is removed to reduce manufacturing costs, it is expected to obtain an effect of preventing the handle section 400 from tearing.

The upper sealing section 300 may be formed to seal the upper section as inner surfaces of the reinforcement film 200 and the packaging sheet 100 adhere to each other.

That is, in a state in which the reinforcement film 200 is first sealed on the first sheet 110, the second sheets 120 formed on both sides of the first sheet 110 face each other to cover the reinforcement film 200. In this state, regions other than the region spaced the certain interval from the rim of the handle section 400 formed on the upper section of the packaging sheet 100 are sealed.

As described above, when the sealing is performed at a portion spaced the certain interval from the rim of the handle section 400, the handle section can be prevented from tearing due to the load of heavy contents such as grain or daily supplies.

The handle section 400 may be positioned at the upper sealing section 300 and formed in a punched form to be gripped by a user. The handle section 400 may be formed in various shapes as long as the handle section is punched in a shape that can be gripped by a user. The handle section 400 may include a folding section 500 formed at the rim so that the first sheet 110 and the second sheets 120 provided at both sides of the reinforcement film 200 are folded into a bundle.

The folding section 500 is an unsealed portion disposed between the rim of the handle section 400 and the upper sealing section 300, and is in a state in which the reinforcement film 200, the first sheet 110 and the second sheets 120 are separated to be folded when a user grips the handle section 400.

Hereinafter, an exemplary embodiment of a method of manufacturing a packaging bag of the present invention will be described in detail with reference to the accompanying drawings.

Figure 5:
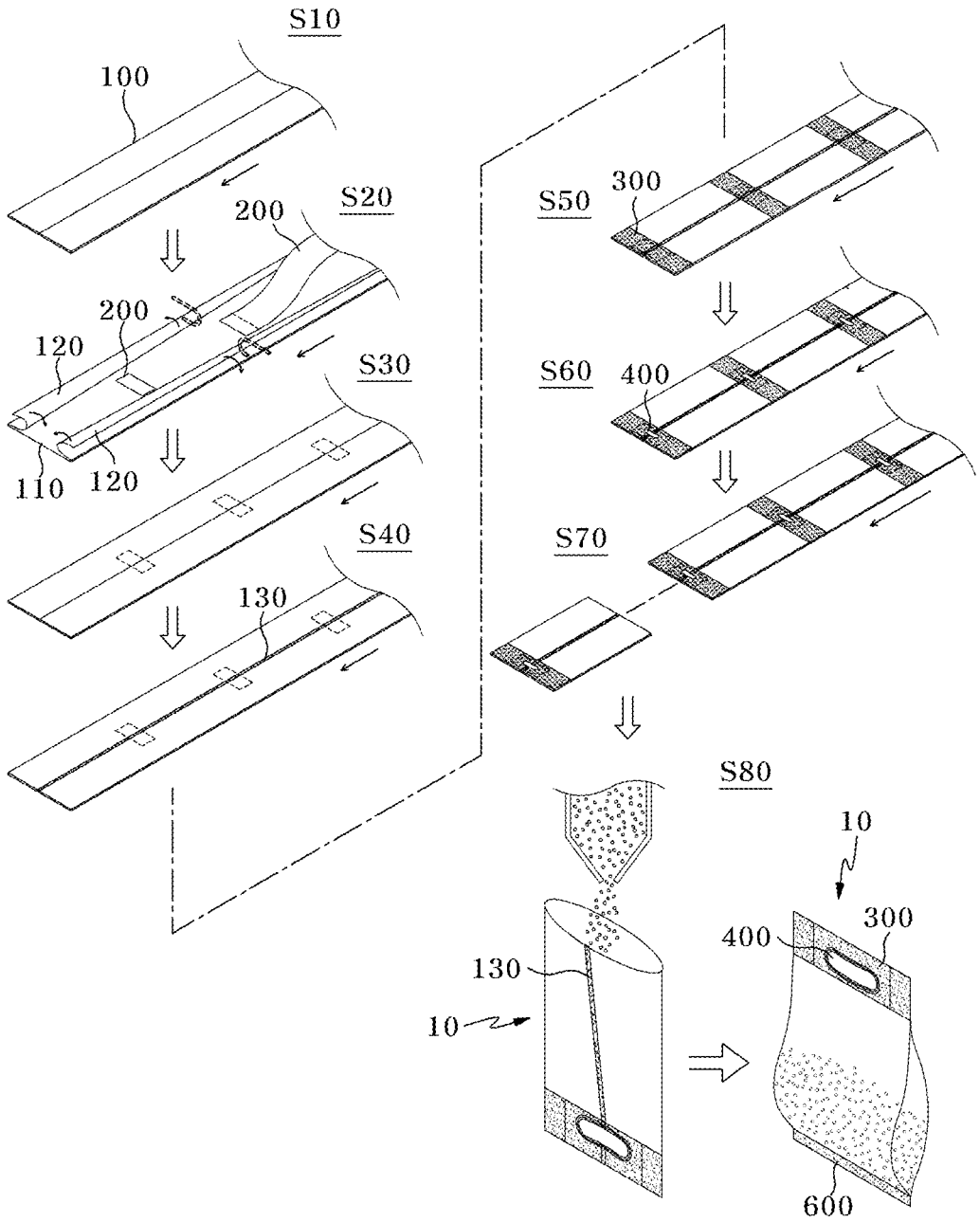
FIG. 5 is a view schematically showing a method of manufacturing a packaging bag according to the present invention.
Figure 6:
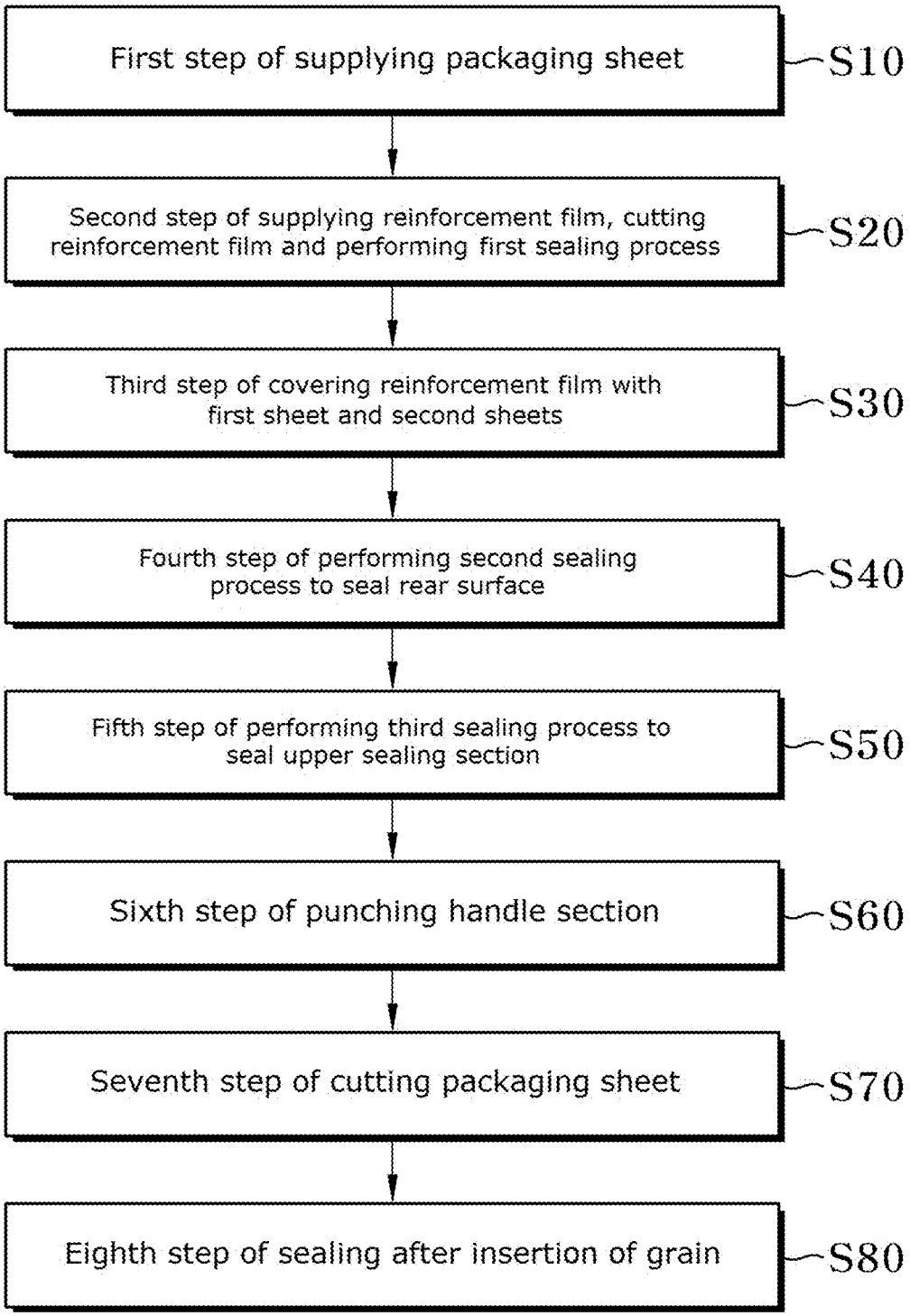
FIG. 6 is a flowchart schematically showing the method of manufacturing the packaging bag according to the present invention.

FIG. 5 is a view schematically showing a method of manufacturing a packaging bag according to the present invention. FIG. 6 is a flowchart schematically showing the method of manufacturing the packaging bag according to the present invention.

Referring to FIGS. 5 and 6, the method of manufacturing the packaging bag according to the present invention includes a first step S10 of supplying a packaging sheet 100, a second step S20 of supplying and cutting a reinforcement film 200 and of performing a first sealing process of sealing the reinforcement film 200, a third step S30 of covering the reinforcement film 200 using a first sheet 110 and second sheets 120, a fourth step S40 of performing a second sealing process of sealing a rear surface thereof, a fifth step S50 of performing a third sealing process of sealing an upper sealing section, a sixth step S60 of punching a handle section 400, a seventh step S70 of cutting the packaging sheet 100, and an eighth step S80 of inserting grain and sealing the sheets.

In the first step S10, the first sheet 110 and the second sheets 120 are supplied to advance in an arrow direction to perform the second step S20 in a state in which the second sheets 120 overlap the first sheet 110.

In the second step S20, the second sheets are made to be spaced apart at a certain interval in an outward direction to obtain a space so that the reinforcement film 200 is easily sealed on the first sheet 110 of the packaging sheet 100 supplied in the first step S10. In the second step S20, the reinforcement film 200 is supplied to be positioned on the first sheet 110, and the reinforcement film 200 is cut while being subjected to the first sealing process to be sealed on the first sheet 110 with a set length. Here, when the reinforcement film 200 is sealed on the first sheet 110, the entire region except for the region on which the handle section 400 and the folding section 500 are to be formed is sealed.

In the third step S30, one ends of the second sheets 120 are folded inward to face each other so that the second sheets 120 spaced outward in the second step S20 are folded on the first sheet 110 to cover the reinforcement film 200.

In the fourth step S40, the second sealing is performed so that the one ends of the second sheets 120 folded to face each other after the operation of the third step S30 adhere in a longitudinal direction to form the rear sealing section 130. In addition, a non-woven fabric is attached to the one ends of the second sheets 120 in the longitudinal direction. When the sealing is performed while the non-woven fabric is attached, the packaging sheet 100 can be prevented from tearing in the sealing process or the rear sealing section 130 can be prevented from melting due to excessive heat. Here, the non-woven fabric is attached to each of the one ends of the second sheets 120 facing each other to be sealed. In addition, the one ends of the opposing second sheets 120 overlap to form the rear sealing section 130 and are sealed in a state in which the non-woven fabric is inserted therebetween.

In the fifth step S50, the third sealing process is performed so that the reinforcement film 200, the first sheet 110 and the second sheets 120 adhere to form the upper sealing section 300. In addition, the sealing is performed so that a margin from the rim of the handle section 400 remains.

In the sixth step S60, the handle section 400 is formed on the region, at which the reinforcement film 200 is sealed, by punching so that a user can easily grip the handle section 400.

In the seventh step S70, the sheets are cut with reference to a set length, that is, between one end of the upper sealing section 300 and the unsealed packaging sheet 100. The cut and separated packaging sheet 100 is sealed at the upper section by the upper sealing section 300, and the lower section thereof is opened so that the grain can be inserted.

In the eighth step S80, after the cut portion of the packaging sheet 100 is opened and the grain is input through the opening, the fourth sealing process is performed to form a lower sealing section 600 so that the opening is sealed.

As can be seen from the foregoing, according to the packaging bag of the present invention, the breakage of a handle section during use due to the load of heavy contents such as grain or daily supplies can be prevented by sealing the handle section at a portion spaced a certain interval from a rim of the handle section, and the occurrence of injury or marks left on a user's hand that grips the handle section due to the load of heavy contents can be minimized by forming a folding section at the handle section.

According to the method of manufacturing the packaging bag of the present invention, durability and productivity of products can be improved, and manufacturing costs of an automated process can be reduced by using a packaging sheet and a reinforcement film that are continuously supplied.

It will be apparent that various embodiments of the present invention can provide various effects that are not specifically mentioned.

While preferred embodiments of the invention have been described with reference to the accompanying drawings, those skilled in the art, to which the invention belongs, should understand that the invention can be implemented in other specific embodiments without modifying the technical idea or essential characteristics. Accordingly, the embodiments described above are merely an example and are considered as not being limited by the foregoing description.

What is claimed is:

1. A packaging bag comprising: a packaging sheet constituted by a first sheet, and second sheets configured to extend from both sides of the first sheet to be folded in a rear-surface direction of the first sheet so that both ends overlap to be sealed;

an upper sealing section disposed at an upper portion of the packaging bag, wherein the upper sealing section is sealed so that inner surfaces of the packaging sheet adhere to seal the upper portion of the packaging bag; and a handle section disposed at an upper portion of the packaging bag and positioned within the upper sealing section; and wherein the handle section is punched to form a handle rim and configured to be gripped, the handle section including a folding section disposed around the handle rim;

the folding section comprising an interval from the handle rim to the upper sealing section, wherein the first sheet is detached and wherein the second sheet is also detached within the folding section, wherein the first sheet disposed within the folding section is configured to fold and the second sheet disposed within the folding section is also configured to fold when the rim of the handle is gripped;

a reinforcement film disposed between the first sheet and the second sheet, and wherein the handle section is disposed on the reinforcement film;

wherein the reinforcement film is disposed in the folding section, and wherein the first sheet is detached from the reinforcement film, and wherein the second sheet is also detached from the reinforcement film; and wherein the reinforcement film is disposed within the folding section when the handle section is gripped.

2. The packaging bag according to claim 1, wherein the packaging sheet includes a rear sealing section sealed in a state in which a non-woven fabric is attached to both sides of the second sheets in contact with the first sheet.

3. The packaging bag according to claim 1, wherein the folding section extends around the entire handle rim providing an interval between the entire handle rim and the upper sealing section where the first sheet is detached from the second sheet.

4. The packaging bag according to claim 1, wherein the handle section is entirely disposed within the upper sealing section.

5. The packaging bag according to claim 1, wherein the first sheet within the folding section folds away from the second sheet when the handle section is gripped.

6. The packaging bag according to claim 1, wherein the second sheet within the folding section folds away from the first sheet when the handle section is gripped.

7. The packaging bag according to claim 1, wherein the folding section is disposed between the handle rim and the upper edge of the packaging bag.

* * * * *